US011549307B2

(12) United States Patent
Torres

(10) Patent No.: US 11,549,307 B2
(45) Date of Patent: Jan. 10, 2023

(54) CORDED TOP DOWN AND CORDLESS BOTTOM UP SHADE MODIFICATION KIT

(71) Applicant: Edwin Torres, Cape Coral, FL (US)

(72) Inventor: Edwin Torres, Cape Coral, FL (US)

( * ) Notice: Subject to any disclaimer, the term of this patent is extended or adjusted under 35 U.S.C. 154(b) by 80 days.

(21) Appl. No.: 16/855,216

(22) Filed: Apr. 22, 2020

(65) Prior Publication Data

US 2020/0392783 A1 Dec. 17, 2020

Related U.S. Application Data

(60) Provisional application No. 62/921,387, filed on Jun. 14, 2019.

(51) Int. Cl.
*E06B 9/266* (2006.01)

(52) U.S. Cl.
CPC ..... *E06B 9/266* (2013.01)

(58) Field of Classification Search
CPC .. E06B 9/266; E06B 9/262; E06B 2009/2625; E06B 2009/2627; E06B 2009/3222; E06B 9/30; E06B 9/323; E06B 9/324; E06B 9/38; E06B 9/388
See application file for complete search history.

(56) References Cited

U.S. PATENT DOCUMENTS

| | | | | |
|---|---|---|---|---|
| 5,318,090 | A | 6/1994 | Chen | |
| 5,482,100 | A | 1/1996 | Kuhar | |
| 5,531,257 | A | 7/1996 | Kuhar | |
| 6,079,471 | A | 6/2000 | Kuhar | |
| 6,129,131 | A | 10/2000 | Colson | |
| 6,234,236 | B1 | 5/2001 | Kuhar | |
| 7,143,802 | B2 * | 12/2006 | Strand | E06B 9/262 160/84.04 |
| 7,546,866 | B2 | 6/2009 | Strand et al. | |
| 8,561,665 | B2 * | 10/2013 | Lin | E06B 9/322 160/84.03 |
| 2008/0196843 | A1 * | 8/2008 | Nien | E06B 9/323 160/178.1 R |
| 2008/0216967 | A1 * | 9/2008 | Liang | E06B 9/326 160/168.1 V |
| 2011/0265962 | A1 * | 11/2011 | Drew | E06B 9/262 160/340 |
| 2014/0144596 | A1 * | 5/2014 | Wu | E06B 9/38 160/167 V |

* cited by examiner

*Primary Examiner* — Daniel P Cahn
*Assistant Examiner* — Jeremy C Ramsey
(74) *Attorney, Agent, or Firm* — Joel Douglas; Thomas Ciesco

(57) ABSTRACT

The invention relates to window coverings modification kit and is more specifically related to cordless blinds for covering window openings modification kit and, more particularly to cordless window coverings modification kit for tall windows.

3 Claims, 11 Drawing Sheets

CORDED TOP DOWN AND CORDLESS BOTTOM UP SHADE MODIFICATION KIT

CROSS-REFERENCE TO RELATED APPLICATION

This application claims priority from U.S. Provisional Patent Application No. 62/921,387, filed Jun. 14, 2019, titled Corded Top Down, Cordless Bottom UP Shade which is hereby incorporated by reference herein for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

Trademarks used in the disclosure of the invention and the applicants make no claim to any trademarks referenced.

BACKGROUND OF THE INVENTION

1) Field of the Invention

The invention generally relates to window coverings modification kit and is more specifically related to cordless blinds for covering window openings modification kit and, more particularly to cordless window coverings modification kit for tall windows.

2) Description of Related Art

Window blinds are typically used for covering window openings. The blinds are usually moveable between an open position so that light may pass through the window and a lowered or closed position in which the window blind at least partially blocks the passage of light. A closed window blind also provides privacy so that individuals outside a building may not look into a building. Most window blinds include a lifting cord, which passes through an aperture in each of the slats or through a window covering material such as cellular or pleated shades.

The art is replete with window blinds and improvement and there have been many improvements related to corded and cordless window blinds. Such improvements attempt to simplify the process of operating a window blind and facilitate cleaning of the blind.

For example, U.S. Pat. No. 1,798,869 discloses a head rail for a Venetian blind including a traversing rod 16 to which there is attached a pair of lift cords. U.S. Pat. No. 1,978,152 discloses a blind incorporating a traversing rod from which there is supported a plurality of slats. The traversing rod may be operated by a hand crank assembly that is coupled via rod to an end of the traversing rod by means of a gear assembly.

U.S. Pat. No. 5,318,090 is directed to a roller assembly for a Venetian blind. The roller assembly includes an elongated driving member having a circular axial hole extending through a rectangular shaft section. The shaft section is received within the end portion of a rotating rod. A guide unit includes a threaded rod extending through the circular axial hole of the driving member and into engagement with a moveable member that is fixed in an intermediate position within the rotating rod. A lift cord is coupled to a portion of the driving member to rotate same in either a clockwise or counterclockwise direction. When the lift cord is pulled, the driving member rotates the rotating rod to move the moveable member along the threaded rod of the guide unit, thereby both rotating and moving the rotating rod along the guide unit.

U.S. Pat. No. RE 35,926 is directed to a Venetian or pleated blind that is adapted to be positioned between a pair of glass panes. The blind includes a housing having two corner spacer elements attached to opposite ends of the head rail housing. Each of the corner spacer elements is attached to respective adjacent side spacer elements on each side of the window. The head rail defined by housing elements includes a traversing rod referred to in the claims as a winding shaft.

U.S. Pat. No. 5,482,100 is directed to a blind including at least one constant variable spring force motor having an elongated spring. The spring has a generally rectangular cross-section that varies in width from one end to the other. The varying spring force is sufficient to maintain the bottom rail in any position with respect to the top rail as the shade material accumulates on the bottom rail when moving the bottom rail towards the head rail.

U.S. Pat. No. 5,531,257 is directed to a cordless blind having a spring motor coupled to an electronic motor. The electronic motor and the spring motor rotate a cord spool to raise or lower the window covering.

U.S. Pat. No. 6,234,236 discloses a cordless window covering system incorporating a plurality of spring motors that are coupled together. Referring to the figures, the system includes at least two springs motors in combination with a coupler. The coupler connects the spring motors together to have a combined spring force. In other embodiments, the pair of spring motors are coupled together and attached to the lift cords.

U.S. Pat. No. 6,079,471 teaches a window covering including a friction-imparting member to Inhibit movement of the bottom rail. The friction and parting member includes a bracket having a plurality of slots that are used to increase the tension on cord traveling through hole in surface towards the cord spool.

U.S. Pat. No. 6,129,131 is generally directed to a blind system including a traversing rod coupled to a pull system that imparts uni-directional movement to the coupling drive shaft. The pull system includes a one-way clutch assembly and a main drive assembly including a single pull tape operative of a drive spool 48. The brake arm is adapted to selectively prevent or permit lowering of the shade by gravity. The traversing assembly includes a compression spring having one end slidably engaged with a disc-shaped end of the cord spool. The other end of the compression spring is attached to a spring support spool that is rotatable by the drive shaft. The compression spring is relatively light, but strong enough to push the cord spool to the left when no counterforce exists.

Other related patents, U.S. Pat. Nos. 6,837,294, 10,415, 303, 7,143,802, 7,546,866, 5,813,447; 5,960,846 and 6,047, 759 all teach a window shade incorporating an internal spring tensioning mechanism, corded and cordless activation. The mechanism are adapted for tensioning a spring upon rotation of the shade bar in one direction and releasing the spring tension upon opposite shade bar rotation, with the releasing of the spring force accomplished by a manual force rotating the shade bar in the tensioning direction.

Despite the above improvements, there remains a need for improved cordless blind assemblies for tall windows. Therefore, what is needed is a conversion kit for cordless blinds where the bottom rail can be activated cordlessly for moving the up and down and a corded head rail that can be moved up or down with a cord.

BRIEF SUMMARY OF THE INVENTION

The invention in one form is directed to a modification kit for a cordless blind for a tall window wherein the bottom rail is capable of being moved up or down cordlessly and the head rail is modified such that it is capable of being moved up or down with a cord.

An advantage of the present invention is that the cord allows the person operating the blind to manipulate the upper blind head rail with a cord and provides the convenience of being able to adjust the bottom rail cordlessly.

BRIEF DESCRIPTION OF THE DRAWINGS

A further understanding of the nature and advantages of particular embodiments may be realized by reference to the remaining portions of the specification and the drawings. In which like reference numerals are used to refer to similar components. When reference is made to a reference numeral without specification to an existing sub-label, it is intended to refer to all such multiple similar components.

Corresponding reference characters Indicate corresponding parts throughout the several views. The exemplifications set out herein illustrate embodiments of the invention and such exemplifications are not to be construed as limiting the scope of the invention in any manner.

DETAILED DESCRIPTION

The term individual, user, client, customer are used interchangeably and refers to a person who is operating a window blind to either open or close it.

Figure 1:
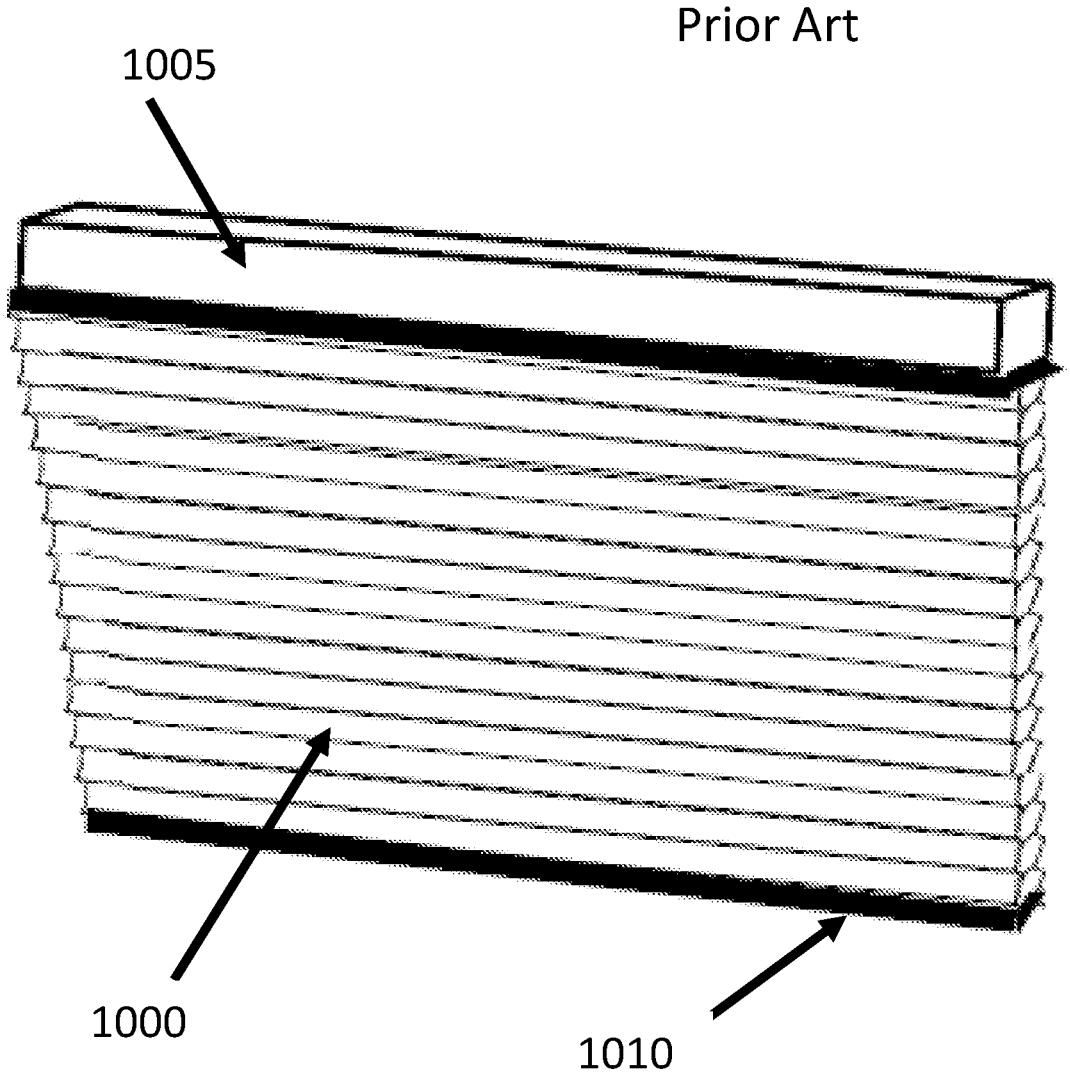
FIG. 1 is a cordless blind of the prior art.

Referring now to the drawings, and more particularly to FIG. 1, there is shown a traditional cordless blind 1000 with the head rail 1005 in the raised position and the bottom rail 1010 in the lower position. This blind allows the customer to move the bottom rail or top rail without having to use a cord attached to the bottom or top rail. The blind works for most customers unless the window is tall and then they cannot raise or lower the head rail which reduces the functionality of the blind.

Figure 2:
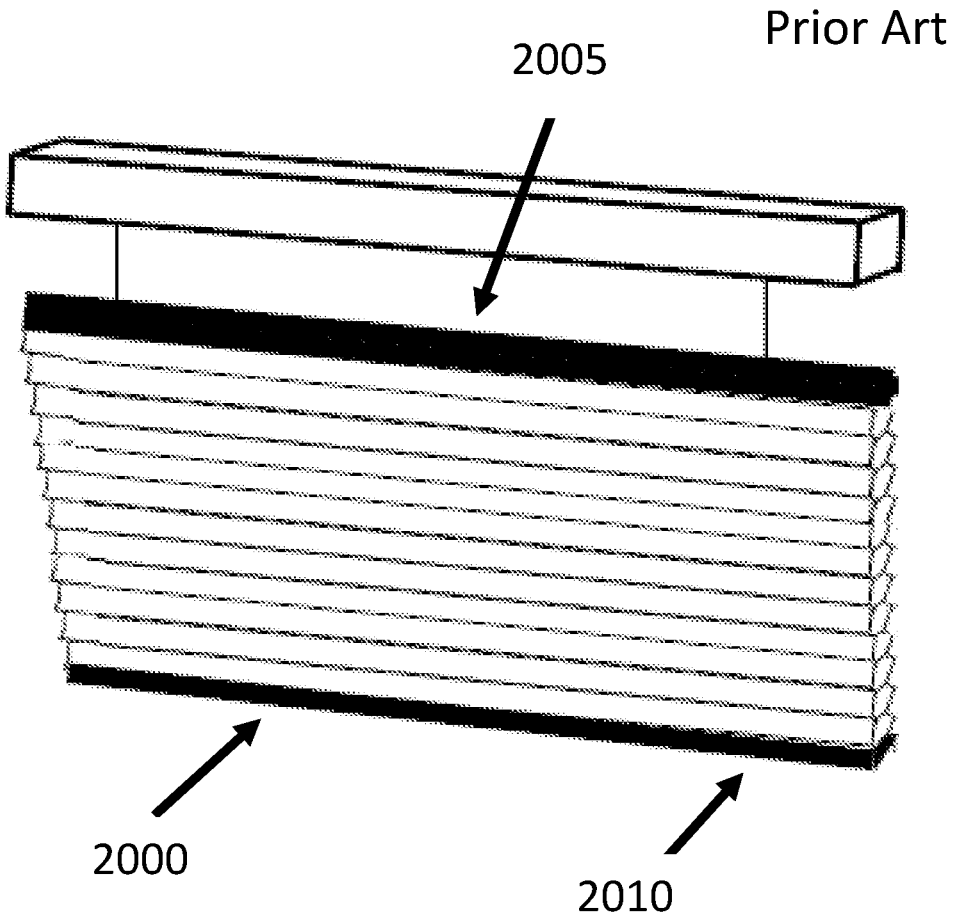
FIG. 2 is a cordless blind of the prior art.

Referring now to FIG. 2, there is shown a traditional cordless blind 2000 of the instant invention showing the head rail 2005 being lowered without pulling on a cord or lowering a cord. To lower the head rail 2005 the customer applies downward pressure to the head rail 2005 and the headrail 2005 moves down. When the customer wants to raise the head rail 2005 the customer provides upward pressure to the head rail and the head rail rise. To move the bottom rail 2010 the customer applies upward pressure to the bottom rail 2010 and the bottom rail 2010 moves up. This blind allows the customer to move the bottom rail 2010 or head rail 2005 without having to use a cord attached to the bottom or top rail. The blind works for most customers unless the window is tall and then they cannot raise or lower the head rail which reduces the functionality of the blind.

Figure 3:
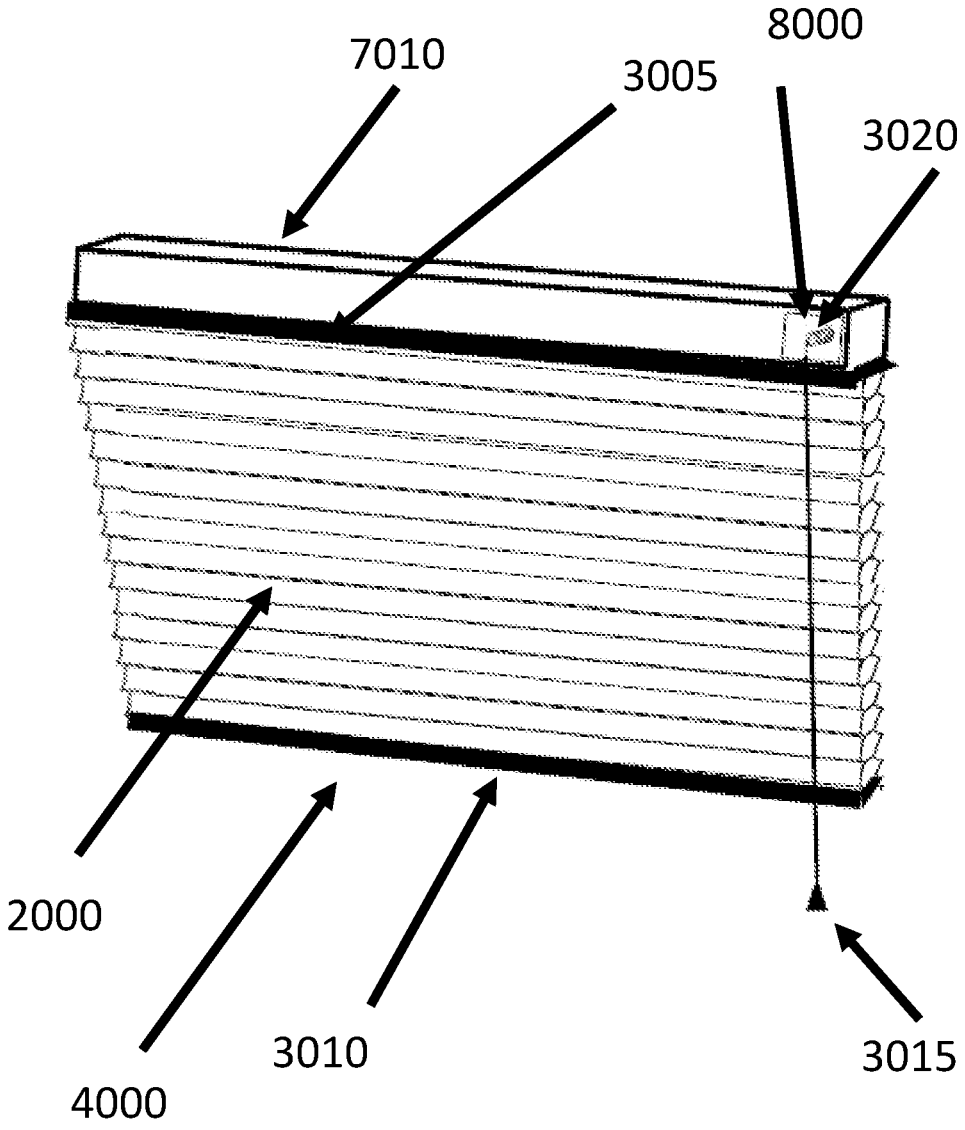
FIG. 3 is blind of the instant Invention showing the cord to move the head rail and cordless bottom rail.
Figure 4:
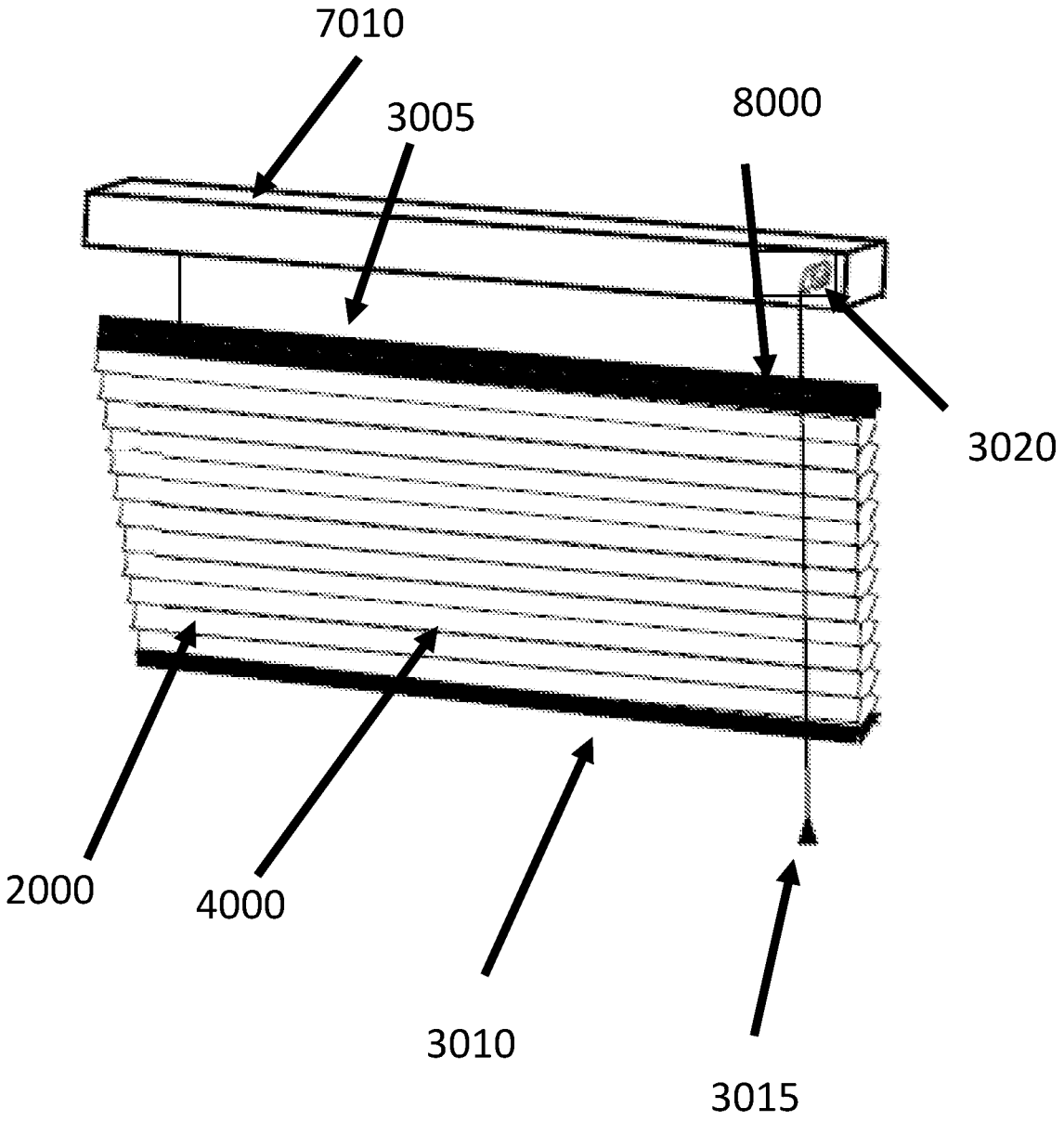
FIG. 4 is blind of the instant Invention showing the cordless bottom rail.

Referring now to FIGS. 3 and 4, there is shown a blind 4000 of the instant invention showing a cord to operate the head rail 3005. By pulling on the cord 3015, the head rail 3005 is raised thereby raising the fabric 2000. To lower the head rail 3005 the customer unlatches the cord 3015 from the cord lock 3020 (which is shown by cutaway 8000 of top support rail 7010 of the cordless blind 1000 and cutaway 8000 allows cord lock 3020 to be seen in FIGS. 3 and 4) and releases the cord 3015 allowing the head rail 3005 to lower. To raise the head rail 3005 the customer unlatches the cord 3015 from the cord lock 3020 and pulls the cord allowing the head rail 3005 to raise up. This blind allows the customer to move the bottom rail 3010 without having to use a cord attached to the bottom and it allows the customer to move the head rail 3005 by using an attached cord 3015. The blind works for customers where the window is tall and then they cannot raise or lower the head rail except for using a step ladder which reduces the functionality of the blind 4000.

Figure 5:
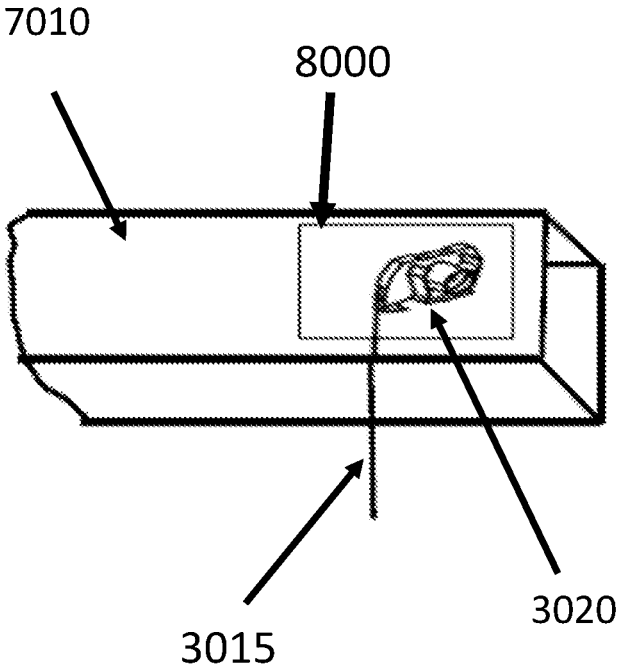
FIG. 5 cord lock used by the instant Invention.
Figure 7:
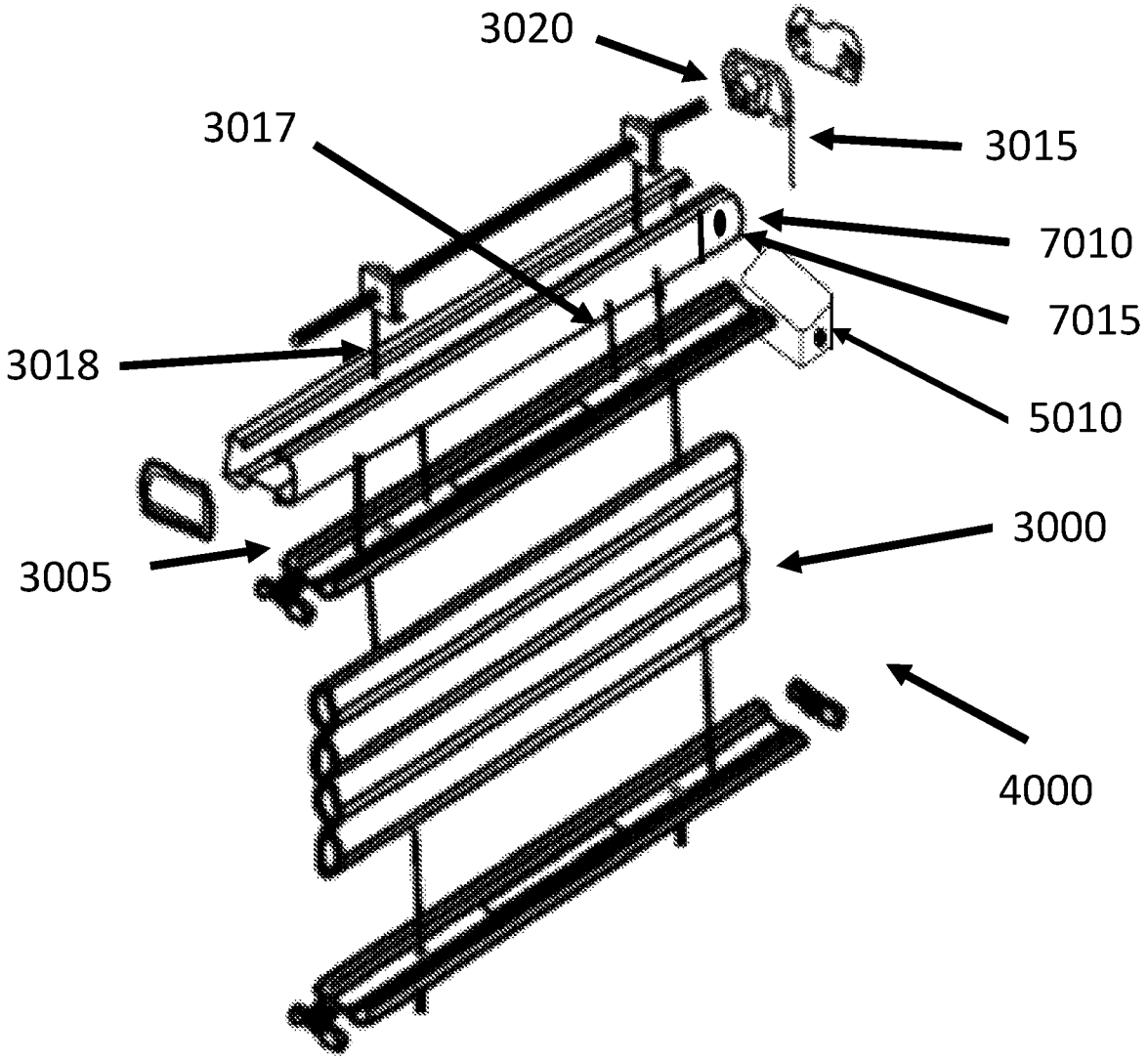
FIG. 7 is shown a retrofit of a blind to have a pull cord top.

FIG. 5 is a picture of the cord lock mechanism 3020 used in the modification kit. The cord 3015 enters the cord lock mechanism 3020 which is connected to shaft 3021 and reels 3035 and 3036 as shown in FIG. 7. Cutaway 8000 of top support rail 7010 allows cord lock 3020 to be seen in FIG. 5. When the cord 3015 is pulled on it raises the head rail 3005 and when released it lowers the head rail 3005 as shown in FIG. 4. Cord 3015 is comprised of external cord 3016, cord union 3019, internal cords 3017 and 3018 as shown in FIG. 7.

Figure 6:
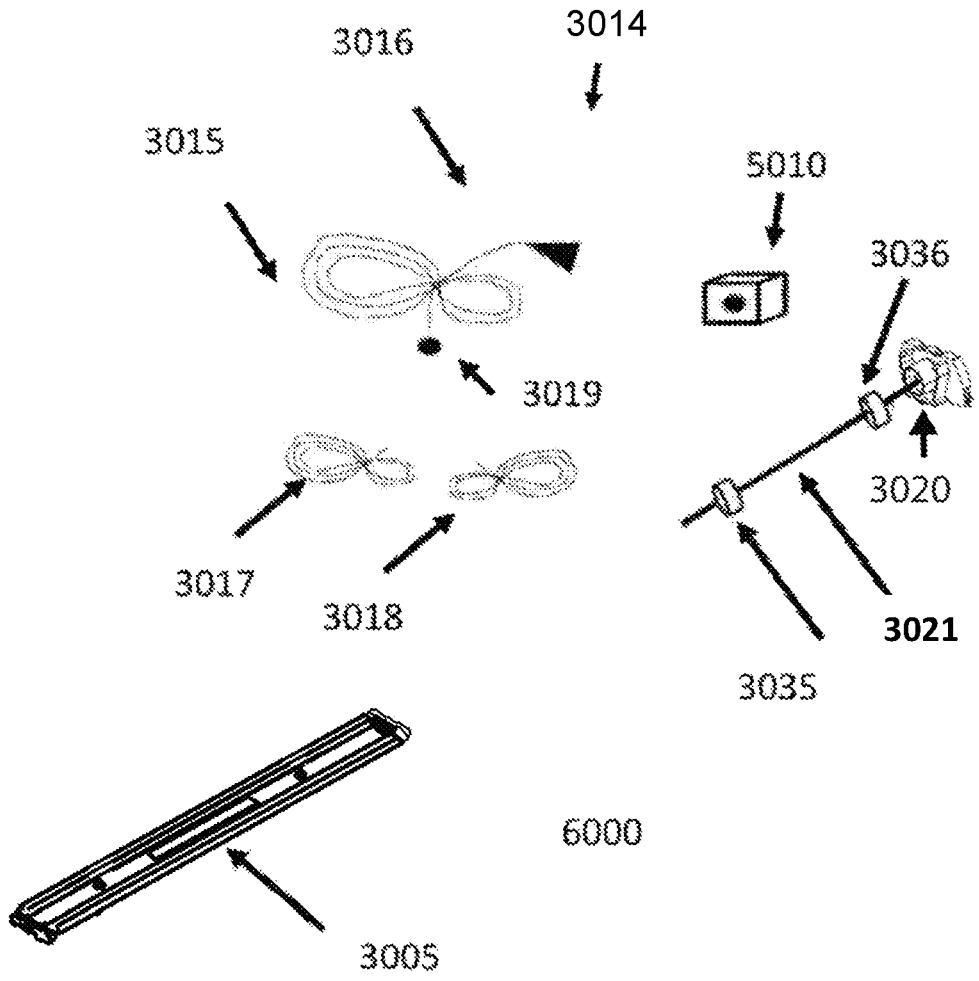
FIG. 6 is the kit of the instant invention.
Figure 13:
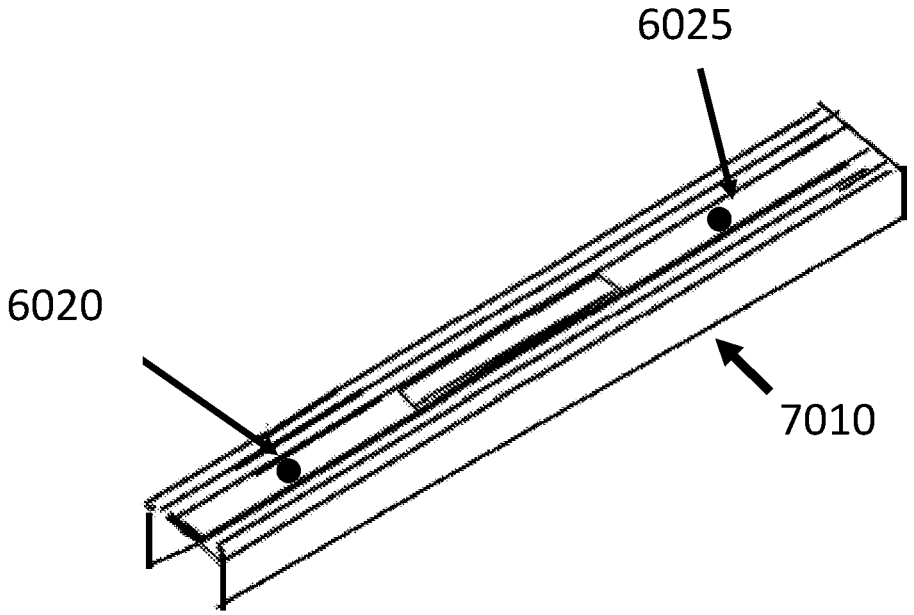
FIG. 13 shows the instant invention with holes in the top support rail.

FIG. 6 shows the kit for converting a cordless blind 4000 to have a head rail operated by a pull cord. The kit is comprised of head rail 3005, cord lock mechanism 3020 having shaft 3021 and reels 3035 and 3036 and pull cord assembly cord 3015 comprised of pull cord 3016, right-side cord 3017 and left-side cord 3018. The kit further comprises drill fixture 5010 which has at least three stop positions to align the drill fixture 5010 to the top support rail 7010 for drilling the pull cord hole 7015 shown in FIG. 7. The drill fixture having one stop for drilling the right cord hole 6020 in the head rail 3005 as shown in FIG. 13 and one stop for drilling the left cord hole 6025 in the head rail 3005 as shown in FIG. 13. Hole 6020 is for the left hand pull cord 3018 and hole 6025 is for the right hand pull cord 3017.

The modification kit of FIG. 6 is use to modify the head rail to provide a cord that operates the head rail separately and allows the bottom rail to be operated as cordless.

As shown in FIG. 7 the first step to retrofit the blind 4000 to have a pull cord top is to remove the drill fixture 5010 from kit 6000 and then remove the top support rail 7010 from the blind 4000 and use the drill fixture 5010 to drill holes for the pull cord 3016 and right-side cord 3017 and left-side cord 3018. The hole for pull cord 3016 is shown as 7015. The lift cords 3017 and 3018 are then threaded through the holes in the top support rail 7010. Install the cord lock mechanism 3020 having shaft 3021 and reels 3035 and 3036 and loosen the reels 3035 and 3036 using the set screws and align them to their respective holes in the top support rail 7010 and tighten the set screws. Next secure the fabric 3000 to the lower surface of head rail 3005. Thread the lift cords 3017 and 3018 over the reels 3035 and 3036 and secure them appropriately so the lift cords will wrap over the reel. Thread the pull cord 3016 through hole 7010 and attach it to the cord lock 3020. Attach the universal cover/tassel 3014 to the pull cord 3016. Reassemble the blind and now the upper head rail moves the upper segment of fabric 3000.

The kit alternatively could have a single lift cords 3017 installed at the center of the blind top support rail 7010. When using a single lift cord the step to retrofit first step to retrofit the blind to have a pull cord top is to remove the drill fixture 5010 from of kit 6000 and then remove the top support rail 7010 from the cordless blind 1000 and using the drill fixture 5010 and drill holes for the pull cord 3016 and a center hole in the center of the top support rail 7010. You then can use either the right-side cord 3017 or left-side cord 3018. Hole for pull cord 3016 is shown as 7015. Then thread lift cord 3017 or 3018 through the hole in the center of the top support rail 7010. Next secure the fabric 3000 to the lower surface of head rail 3005. Loosen the set screw on the reel 3036 for the right-side cord and position it over the center hole and retighten the set screw. Thread the lift cords 3017 or 3018 over the reel 3036 and secure it appropriately so the lift cords will wrap over the reel. Thread the pull cord 3016 through hole 7010 and attach it to the cord lock 3020. Attaching the universal cover/tassel to the pull cord 3016. Reassemble the blind and now the upper head rail moves the upper segment of fabric 3000.

The kit for converting a cordless blind to have a head rail operated by a pull cord and a single lift cord. The kit is comprised of head rail 3005, cord lock mechanism cord 3020 having shaft 3021 and reels 3035 and 3036, pull cord assembly cord 3015 comprised of pull cord 3016 and right-side cord 3017, drill fixture 5010 which has at least three stop positions to align the drill fixture 5010 to the top support rail 7010.

Figure 8:
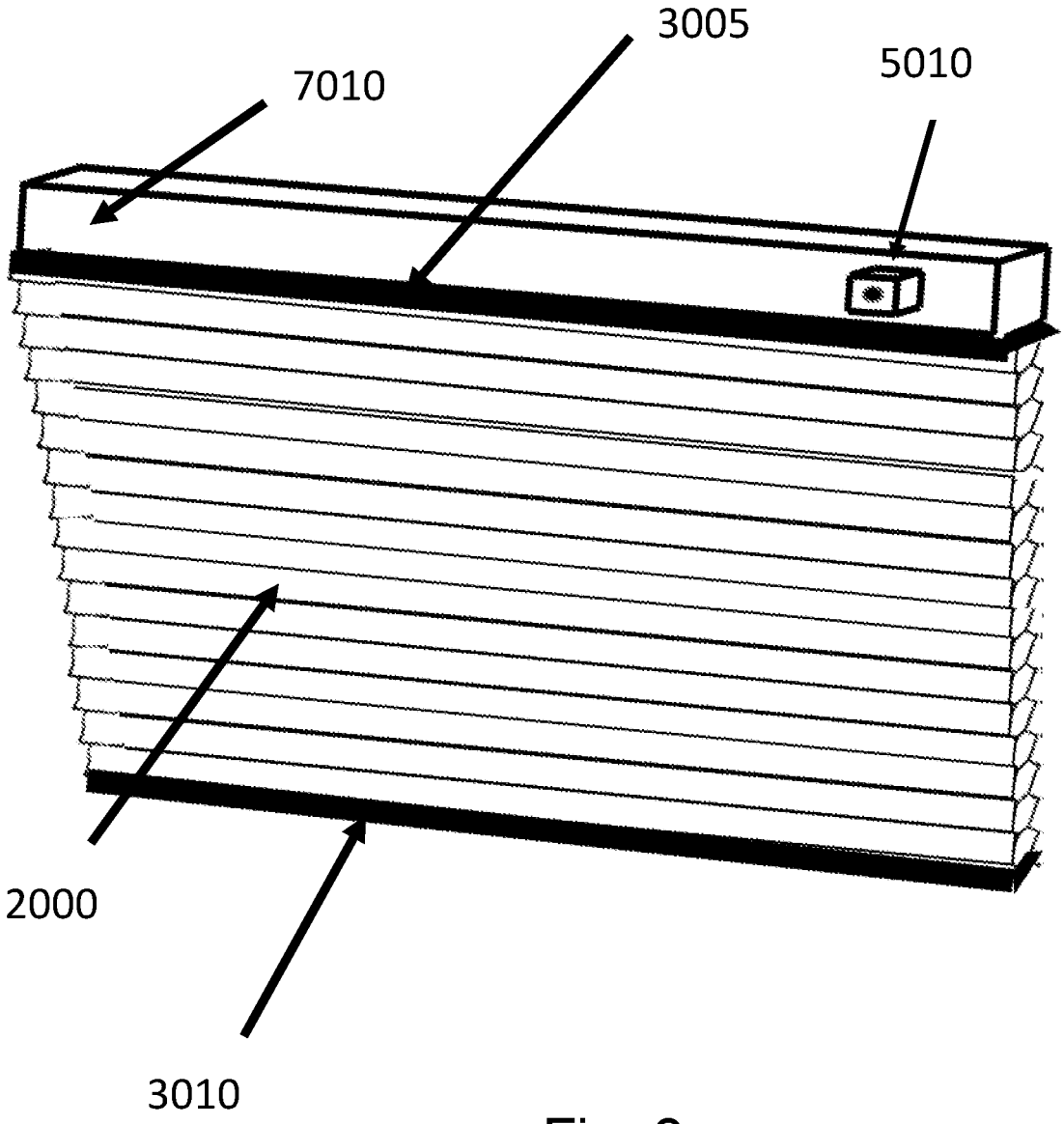
FIG. 8 shows the instant invention with drill fixture positioned on the top support rail.

FIG. 8 shows the instant invention with drill fixture 5010 positioned on head rail 3005. The user of the kit 6000 positions the drill fixture 5010 and using the drill fixture 5010 and a suitable drill drills a hole 7015 for pull cord assembly cord 3015 in the head rail 3005.

Figure 9:
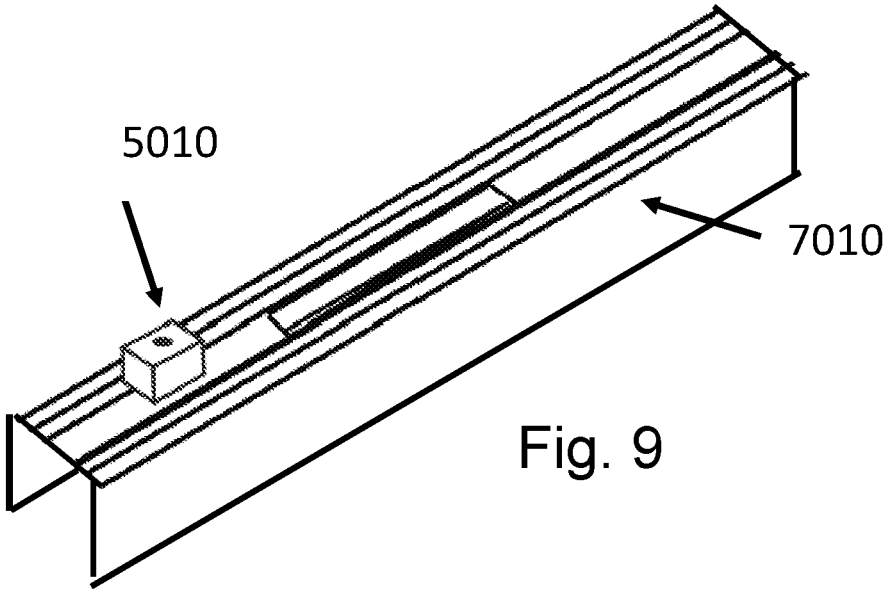
FIG. 9 shows the instant invention with drill fixture positioned on bottom of top support rail to drill the left hole.

FIG. 9 shows the instant invention with drill fixture 5010 positioned on head rail 3005 to drill the left hole 6020 shown in FIG. 13. The user of the kit 6000 positions the drill fixture 5010 and using the drill fixture 5010 and a suitable drill drills a left hole 6020 in the head rail 3005.

Figure 10:
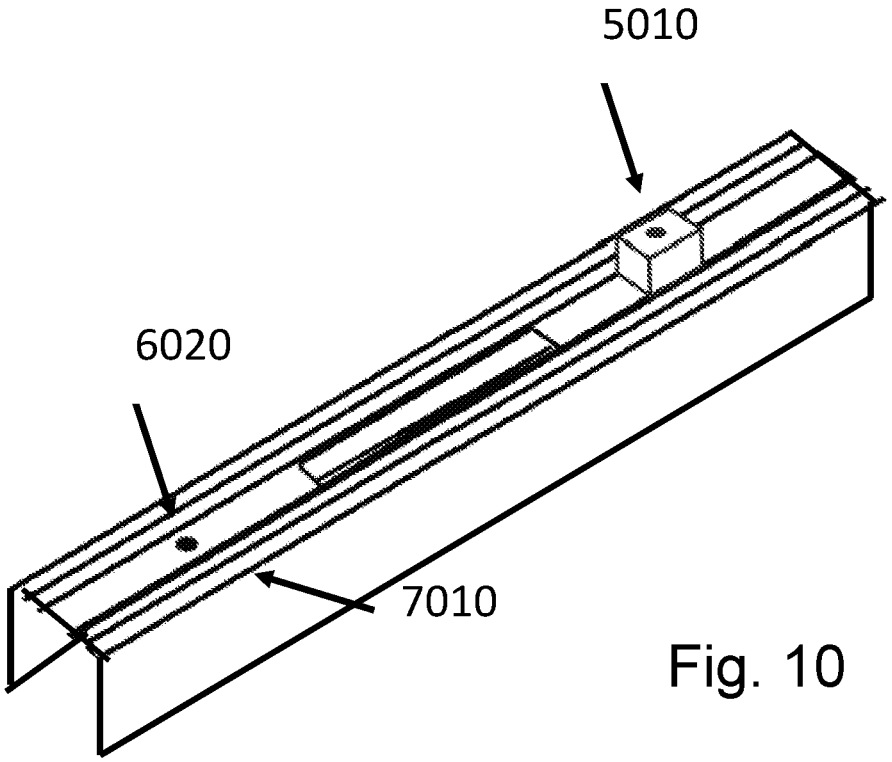
FIG. 10 shows the instant invention with drill fixture positioned on the bottom of top support rail to drill the right hole.

FIG. 10 shows the instant invention with drill fixture 5010 positioned on head rail 3005 to drill the right hole. The user of the kit 6000 positions the drill fixture 5010 and using the drill fixture 5010 and a suitable drill drills a right hole 6025 in the head rail 3005.

Figure 11:
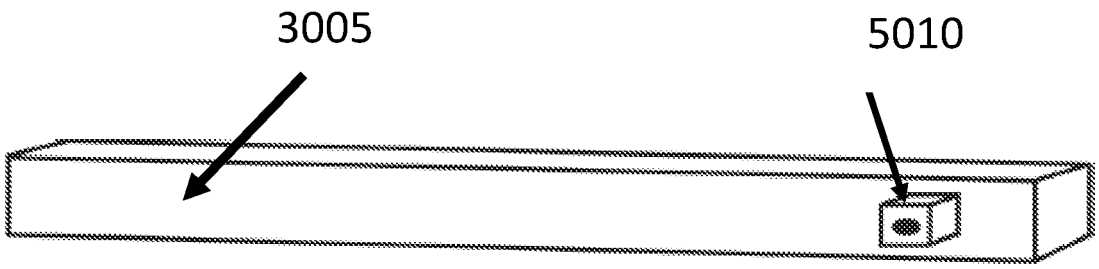
FIG. 11 shows the instant invention with drill fixture positioned on the bottom of head rail to drill the right hole the right pull cord.
Figure 12:
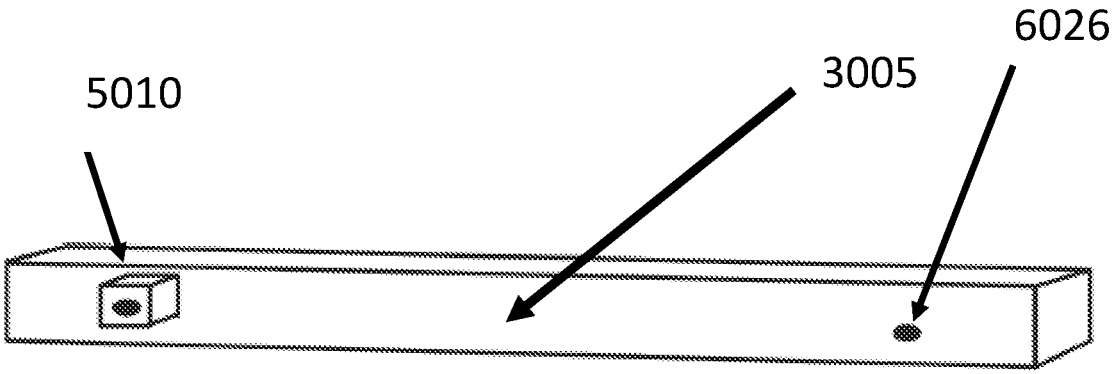
FIG. 12 shows the instant invention with drill fixture positioned on the bottom of head rail to drill the left hole the left pull cord.

FIG. 11 shows the instant invention with drill fixture 5010 positioned on the bottom of head rail 3005 to drill the right hole 6026 shown in FIG. 12 for the right lift cord 3017.

Figure 14:
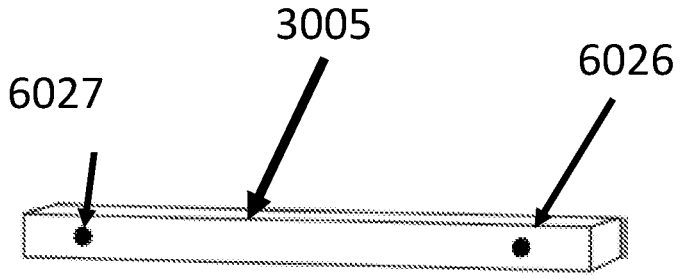
FIG. 14 shows the instant invention with holes in the head rail.

FIG. 12 shows the instant invention with drill fixture 5010 positioned on the bottom of head rail 3005 to drill the left hole 6021 shown in FIG. 14 for the left lift cord 3018.

FIG. 13 shows the instant invention with hole 6020 and hole 6025 in the top support rail 7010.

FIG. 14 shows the instant invention with hole 6027 and hole 6026 in the head rail 3005.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of modifying a cordless blind comprising a top support rail and a fabric panel by modifying said top support rail of said cordless blind using a kit comprising of the steps:

a. removing said top support rail from said cordless blind;
b. installing a drill fixture from said kit and drilling a pull cord hole in a front of said top support rail for a pull cord using said drill fixture;
c. installing said drill fixture from said kit on a left-side bottom of said top support rail and drilling a top support rail left-side lift cord hole using said drill fixture;
d. installing said drill fixture from said kit on a right-side bottom of said top support rail and drilling a top support rail right-side lift cord hole using said drill fixture;
e. inserting a cord lock mechanism from said kit comprising of a cord lock, a shaft and a right reel having a right cord and a left reel having a left cord into said top support rail;
f. aligning said right reel so that it is in line with said top support rail right-side cord hole and threading said right cord through said top support rail right-side cord hole;
g. aligning said left reel so that it is in line with said top support rail left-side cord hole and threading said left cord through said top support left right-side cord hole;
h. attaching said right cord to a head rail from said kit by inserting said right cord into said head rail having a right-side cord hole and securing it to said head rail from said kit;
i. attaching said left cord to said head rail from said kit by inserting it in said head rail having a left-side cord hole and securing it to said head rail;
j. attaching said pull cord to said cord lock mechanism and inserting said pull cord in said pull cord hole;
k. attaching said fabric panel to said head rail from said kit;
l. attaching a universal cover to said pull cord;
m. installing said top support rail above a window.

2. The method of modifying the cordless blind of claim 1 wherein said drill fixture comprises at least three stop positions to align said drill fixture to the top support rail.

3. The method of modifying the cordless blind of claim 1 wherein said kit is comprised of said head rail, said cord lock mechanism cord, said pull cord assembly cord, said universal cover and said drill fixture.

* * * * *